US008191210B2

(12) United States Patent
Devers

(10) Patent No.: US 8,191,210 B2
(45) Date of Patent: Jun. 5, 2012

(54) DEVICE HOLDING STRUCTURE

(76) Inventor: Brock L. Devers, Vincennes, IN (US)

( * ) Notice: Subject to any disclaimer, the term of this patent is extended or adjusted under 35 U.S.C. 154(b) by 0 days.

(21) Appl. No.: 12/381,771

(22) Filed: Mar. 17, 2009

(65) Prior Publication Data

US 2009/0229088 A1 Sep. 17, 2009

Related U.S. Application Data

(60) Provisional application No. 61/069,673, filed on Mar. 17, 2008.

(51) Int. Cl.
*A44C 5/14* (2006.01)

(52) U.S. Cl. ..... 24/265 WS; 24/DIG. 16; 224/170; 224/218

(58) Field of Classification Search ..... 24/265 WS, 24/DIG. 16, 164, 174, 176, 178, 180; 63/3, 63/11, 5.1, 3.2; 602/21; 224/170, 218; 294/25; 401/8; 359/517; 81/489, 490, 492; 2/160
See application file for complete search history.

(56) References Cited

U.S. PATENT DOCUMENTS

| | | | | | |
|---|---|---|---|---|---|
| 223,043 | A | * | 12/1879 | Hamilton, Jr. | 63/11 |
| 601,982 | A | * | 4/1898 | Peirson | 224/170 |
| 1,055,579 | A | * | 3/1913 | Wachter | 224/173 |
| 1,204,663 | A | * | 11/1916 | Hockenhull | 30/123.5 |
| 1,217,905 | A | * | 3/1917 | Boice | 30/123.5 |
| 1,294,938 | A | * | 2/1919 | Mullen | 359/517 |
| 1,486,608 | A | * | 3/1924 | Schroeder | 368/315 |
| 1,583,754 | A | * | 5/1926 | Rogers | 294/25 |
| 1,872,218 | A | * | 8/1932 | Asplund | 359/517 |
| 2,771,224 | A | * | 11/1956 | Boerger | 222/210 |
| 2,855,683 | A | * | 10/1958 | Wayant et al. | 33/501 |
| 3,269,728 | A | * | 8/1966 | Blough | 473/62 |
| 3,942,194 | A | * | 3/1976 | Winter | 623/65 |
| 3,981,526 | A | * | 9/1976 | Lundqvist | 294/25 |
| 4,414,714 | A | * | 11/1983 | Kostanecki et al. | 24/265 WS |
| 4,447,912 | A | * | 5/1984 | Morrow | 2/159 |
| 4,681,462 | A | * | 7/1987 | Lloyd | 368/69 |
| 5,749,841 | A | * | 5/1998 | Moore | 602/21 |
| 5,779,113 | A | * | 7/1998 | Huang | 224/172 |
| 6,102,880 | A | * | 8/2000 | Nelson et al. | 602/21 |
| 6,119,315 | A | * | 9/2000 | Gay | 24/68 J |
| 6,360,928 | B1 | * | 3/2002 | Russo | 224/218 |
| 6,519,207 | B1 | * | 2/2003 | Lukacsko | 368/10 |
| 6,598,271 | B2 | * | 7/2003 | Nire | 24/303 |
| 6,991,364 | B2 | * | 1/2006 | Yang | 368/281 |
| 7,334,711 | B1 | * | 2/2008 | Winters | 224/217 |
| 2010/0177604 | A1 | * | 7/2010 | Ginter | 368/282 |

* cited by examiner

*Primary Examiner* — Robert J Sandy
*Assistant Examiner* — Rowland D Do
(74) *Attorney, Agent, or Firm* — Gary K. Price

(57) ABSTRACT

A holding structure including a first band and a second band used with a prior art device such as a watch casing. The first band includes a first end with connecting elements of the casing, and a buckle and a bar. The first band defines an angle such that when the device is placed upon the top of the wearer's hand the first band downwardly extends below the individual's fifth or smallest finger immediately above the wearer's wrist. The second band attaches to the casing and first and second band members. The buckle is attached to one of a plurality of holes in the second band member such that the first band and second band member encircle the wearer's hand below the base of the wearer's thumb. The first band member passes between the wearer's thumb and index finger such that a clasp extends around the thumb and attaches to a connecting element of the second band member below the wearer's thumb on the palm-side of the wearer's hand.

9 Claims, 4 Drawing Sheets

DEVICE HOLDING STRUCTURE

CROSS REFERENCES TO RELATED APPLICATIONS

U.S. Provisional Application for Patent No. 61/069,673, filed Mar. 17, 2008, with title "Method Of Wearing A Watch On The Back Of The Hand" which is hereby incorporated by reference. Applicant claim priority pursuant to 35 U.S.C. Par. 119(e)(i).

Statement as to rights to inventions made under federally sponsored research and development: Not Applicable.

BACKGROUND OF THE INVENTION

1. Field of the Invention

This invention relates generally to a structure for holding a device, such as a watch, and more particularly to a structure for holding a device on the back of the hand such that the face of the device is in view to the wearer at all times.

2. Brief Description of Prior Art

The wrist watch is known in the art and commonly includes a band that is known to be worn around the wearer's wrist. The common wrist watch, while generally considered as being convenient, has its imperfections. For example, it is very common for the prior art wrist band to allow the watch to rotate upon the wrist when being worn. As a result the wearer, when wishing to see the time, is required to return the watch face to the top of the wrist so that the face is again in view. This "adjusting process" is at the very least frustrating and can be difficult when for example, the wearer does not have a free hand available to adjust or rotate the wrist band. Also, when the wearer is wearing a long sleeve shirt or top, the face of the watch is often concealed under the sleeve portion of the top. Consequently, the wearer is required to slide the sleeve portion upwardly until the sleeve no longer conceals. Again, this can be frustrating at the very least. Also both examples given causes delay in viewing or checking the current time.

As will be seen from the subsequent description, the preferred embodiments of the present invention overcome disadvantages of the prior art.

SUMMARY OF THE INVENTION

A device holding structure generally including a first band and a second band being used in association with a prior art device such as a watch casing. The first band includes a first end with means for attaching to connecting elements of the casing. The first band further includes a buckle and a bar known in the art, and defines an angle such that when the device is placed upon the top of the wearer's hand the first band downwardly extends below the individual's fifth or smallest finger immediately above the wearer's wrist.

The second band includes a first band member, a second band member, and a first end with means for attaching to the connecting elements of the casing.

The first band member includes a distal end with a clasp for attaching to an element of the second band member. The second band member further includes a distal end having a plurality of aligned loop holes for attaching with the buckle and bar of the second end.

The band members are such length that when the watch is placed on the top or back of the wearer's hand, the first band member passes between the wearer's thumb and index finger so that the clasp extends around the thumb and attaches to the element The second band member extends around the base of the thumb attaches to the buckle of the second end at approximately the side of the hand below the individual's fifth or smallest finger. The plurality of aligned loop holes provide means for varying the length of the band member in accordance with the circumference of the wearer's hand.

DESCRIPTION OF THE PREFERRED EMBODIMENT

Figure 1:
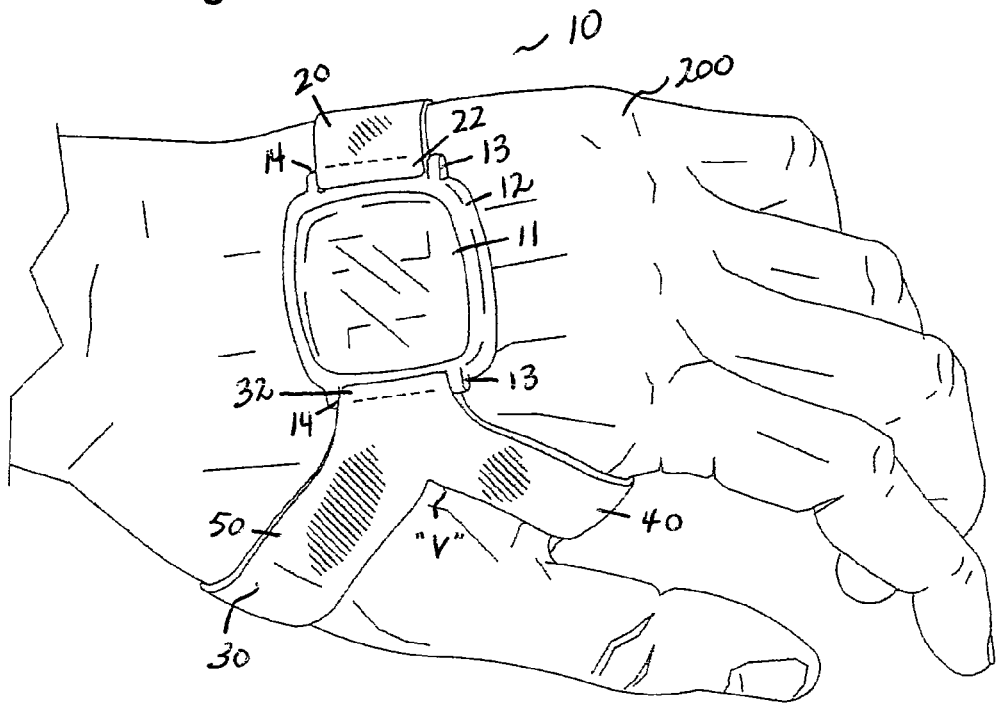
FIG. 1 illustrates a preferred embodiment of the present invention, a device holding structure supported on a wearer's hand and in particular, viewed from the top or back of a wearer's hand.

In accordance with the present invention, a device holding structure is disclosed. The device holding structure of the present invention is directed to a structure for holding a device such as a watch on the back of the hand such that the face of the watch is in view to the wearer at all times. In the broadest context, the device holding structure of the present invention consists of components configured and correlated with respect to each other so as to attain the desired objective.

FIGS. 1-4 illustrate a device holding structure 10 made in accordance with the present invention. The drawings show the device holding structure 10 generally including a first band 20 (best shown in FIG. 3) and a second band 30 (best shown in FIG. 4) being used in association with a prior art watch casing 12. The casing 12 is the enclosure of the watch mechanism, with a watch face 11 on the upper side showing the time. The casing 12 can be shaped in various forms and is generally known in the art.

As is further known in the art, the casing 12 includes connecting elements 13 on opposing ends of the casing 12 for connecting to the bands 20, 30 by such means as a pin 14, again well known in the construction of wrist watches.

Figure 3:
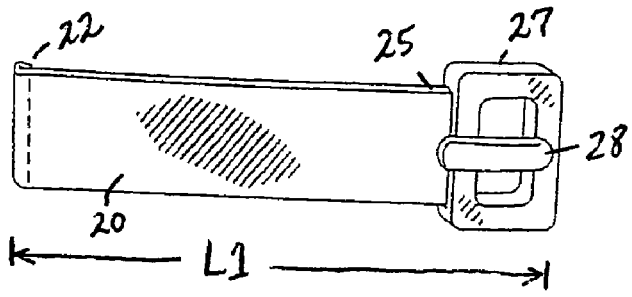
FIGS. 3 & 4 show further details of the device holding structure illustrated in FIG. 1.

As best shown in FIG. 3, the first band 20 includes a first end 22 with means known in the art for attaching to one of the connecting elements 13 of the casing 12 as previously described. The first band 20 further includes a second end 25 opposite the first end 22. The second end 25 including a buckle 27 having a bar 28 known in the art. Preferably, the first band 20 has a length, illustrated as L1 in FIG. 3, of about 3 inches.

Figure 5:
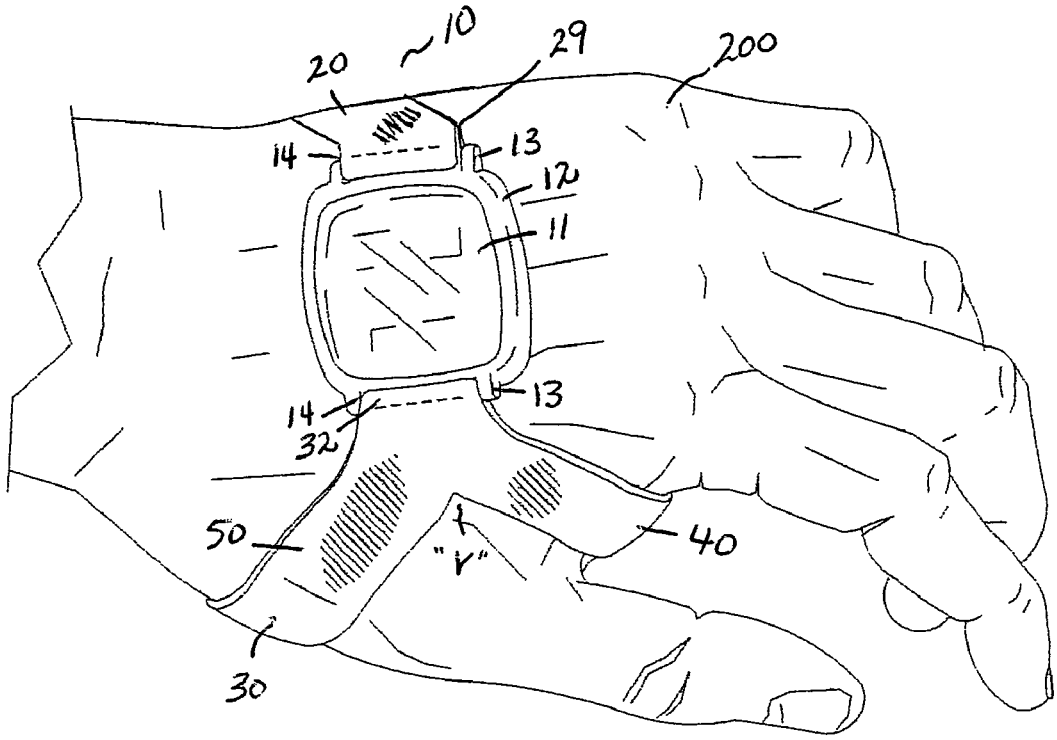
FIG. 5 shows further details of a first band of the device holding structure of FIG. 1.

FIG. 5 shows the first band 20 now including an angle 29 immediately adjacent to where the band 20 connects to the casing 12. The angle 29 is such that when the device is placed upon the top of the wearer's hand 200, the first band 20 will further downwardly extend below the individual's fifth or smallest finger immediately above the wearer's wrist.

Figure 4:
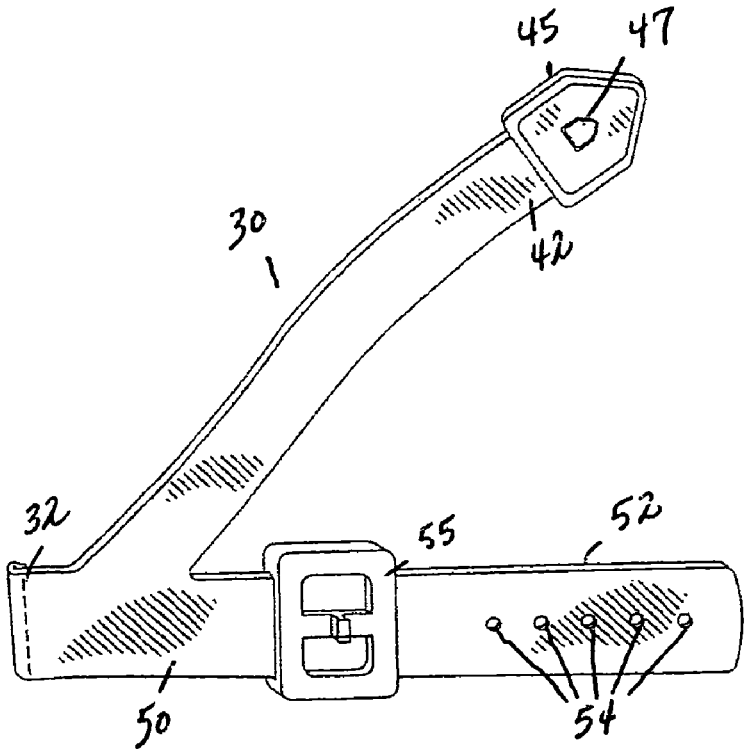

As best shown in FIG. 4, the second band 30 includes a first band member 40 and a second band member 50 which as illustrated, generally has a Y-configuration that defines a "V" configuration between the first and second band members 40 and 50.

The second band 30 includes a first end 32 with means known in the art for attaching to one end of the connecting elements 13 of the casing as previously described.

The first band member 40 includes a distal end 42 that includes a clasp 45 for, as will be described, attaching to an element 55 of the second band member 50. The clasp 45 includes a releasable button 47 for locking and releasing the clasp 45 with the element 55.

The second band member 50 includes the element 55 disposed approximately midway the length of the member 50, and a distal end 52 that includes a plurality of aligned loop holes 54 which loop holes 54, as will be described, for attaching with buckle 27 and bar 28 of the second end 25. The element 55 is adapted to releasably receive the clasp 45.

Figure 2:
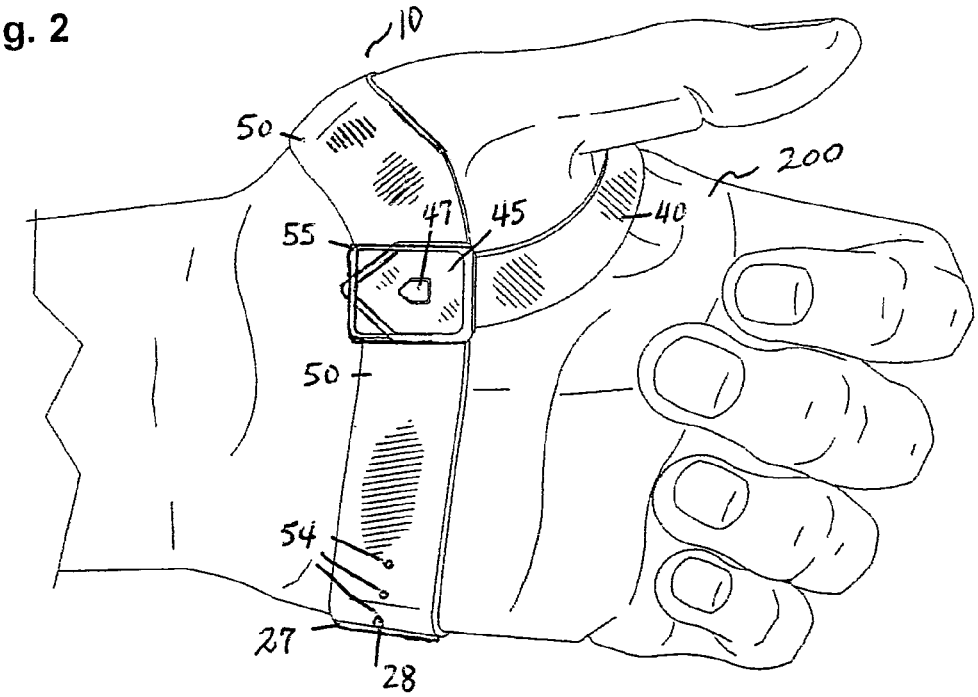
FIG. 2 illustrates the device holding structure of FIG. 1, viewed from the palm-side of the wearer's hand.

The band members 40 and 50 are such length that when the watch is placed on the top or back of the wearer's hand 200 as shown in FIG. 1, the first band member 40 cooperates with the watch to pass between the wearer's thumb and index finger as shown so that the clasp 45 extends around the thumb and attaches to the element 55 approximately below the thumb on the palm-side of the wearer's hand as shown in FIG. 2.

The second band member 50 likewise cooperates with the watch and extends around the base of the thumb attaches to the buckle 27 of the second end 25 at approximately the side of the hand below the individual's fifth or smallest finger as best shown in FIG. 2. Its connection is adjustable whereby the band encircling the wearer's hand below the base of the thumb formed by second end 25 and second band member 50 may be varied in size to fit the wearer's hand by selectively inserting the bar 28 of the buckle 27 into the correct hole of the plurality of aligned loop holes 54. The plurality of aligned loop holes 54 provide means for varying the length of the band member in accordance with the circumference of the wearer's hand.

As should now be understood, the second band 30 having the first band member 40 and the second band member 50 completely encircle the thumb and lower portion of wearer's hand (just above the wrist) to prevent the watch casing from shifting on the hand while being worn.

The first band 20 extends from the casing 12 as previously described to the side of the hand below the individual's fifth or smallest finger and attaches with the aligned loop holes 54 of the distal end 52 of the second band member 50.

The bands 20, 30 is relatively small in cross-section and may be in the form of leather, a plastic, or any other material applicable for the disclosed purpose. The watch holding structure disclosed is simple and inexpensive to manufacture, is light weight, and presents a very neat and attractive appearance to the eye when worn, as indicated in FIG. 1.

Figure 6:
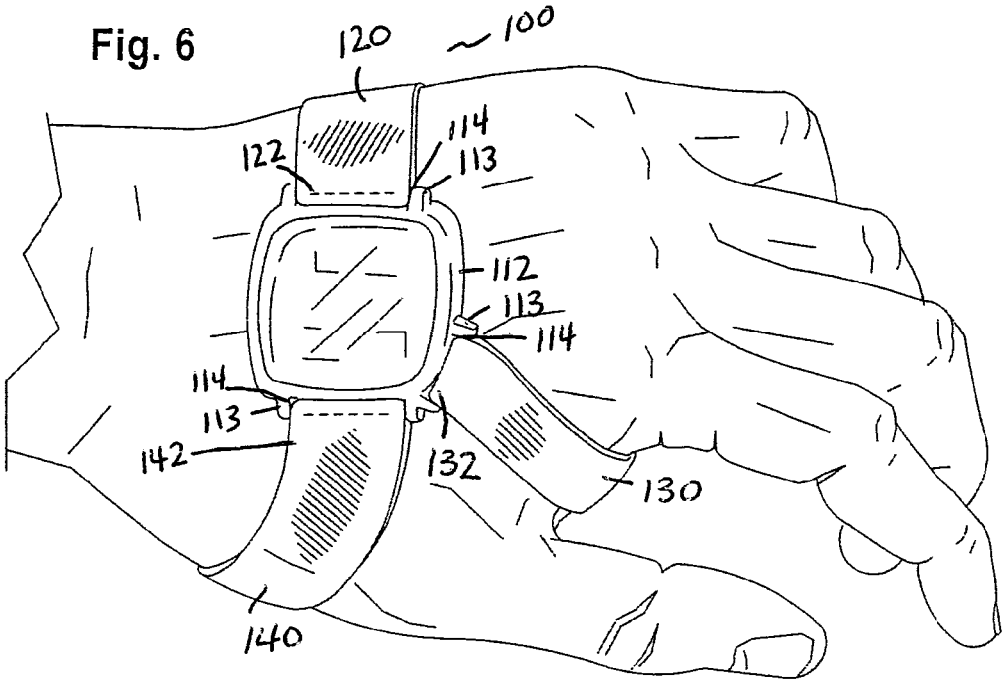
FIG. 6 illustrates an alternate embodiment of a device holding structure supported on a wearer's hand, viewed from the top or back of a wearer's hand.
Figure 7:
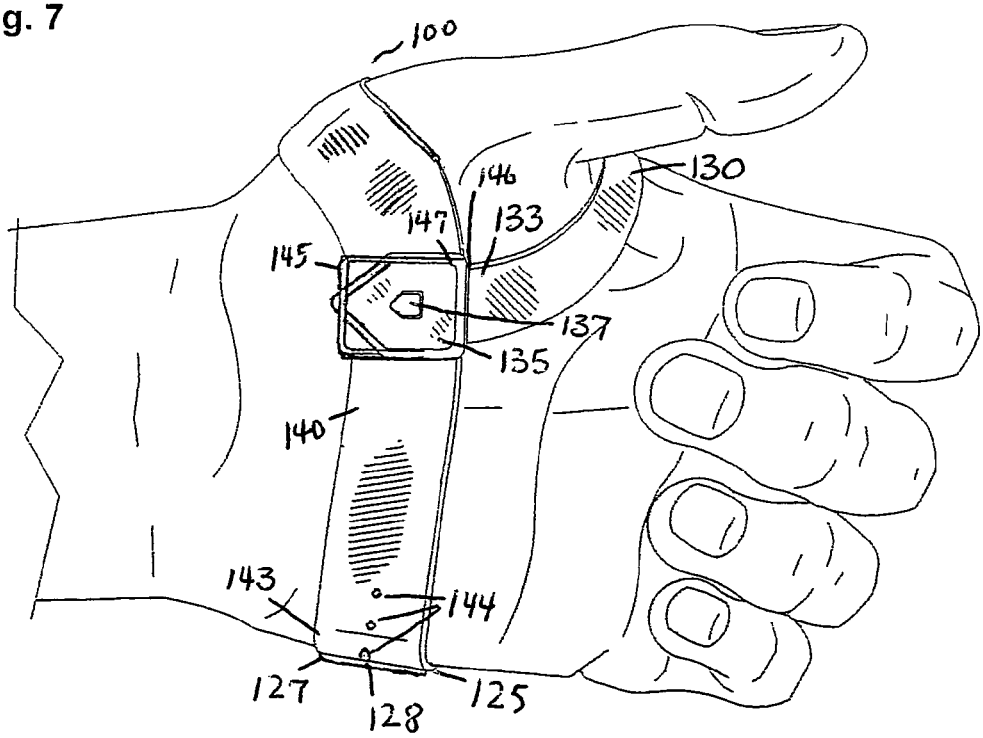
FIG. 7 illustrates the alternate embodiment of FIG. 6, viewed from the palm-side of the wearer's hand.

FIGS. 6 & 7 illustrate a device holding structure of slightly different construction from the form illustrated in FIGS. 1-5. In the embodiment illustrated, the device holding structure, designated as numeral 100 generally includes a first band 120, a second band 130 and a third band 140. In this illustration the structure 100 is being used with a watch casing 112. The casing 112 includes three (3) connecting elements 113 for connecting to the bands 120, 130 and 140 by such means as a pin 114, again well known in the construction of wrist watches.

The first band 120 includes a first end 122 with means know in the art for attaching to one of the connecting elements 113 of the casing 120 as previously described. The first band 120 further includes a second end 125 opposite the first end 122. The second end including a buckle 127 having a bar 128 known in the art. Preferably, the first band 120 has a length of about 3 inches.

The second band 130 includes a first end 132 with means known in the art for attaching to one end of the connecting elements 113 of the casing as previously described and a distal end 133 that includes a clasp 135 for, as will be described, attaching to an element 145 of the third band 140. The clasp 135 includes a releasable button 137 for locking and releasing the clasp 135 with the element 145.

The third band 140 includes a first end 142 with means known in the art for attaching to one end of the connecting elements 113 of the casing as previously described, the element 145 disposed approximately midway the length of the third band 140, and a distal end 143 that includes a plurality of aligned loop holes 144 which loop holes 144, as will be described, for attaching with buckle 127 and bar 128 of the second end 125. The element 145 includes an aperture 146 adapted to receive the clasp 135, and an edge 147 for communicating with the releasable button 137 of the clasp 135.

The bands 130,140 are such length that when the watch is placed on the top or back of the wearer's hand as shown in FIG. 6, the second band 130 cooperates with the device to pass between the wearer's thumb and index finger as shown so that the clasp 135 extends around the thumb and attaches to the element 145 approximately below the thumb on the palm-side of the wearer's hand.

The third band 140 likewise cooperates with the watch and extends around the base of the thumb and attaches to the buckle 127 of the second end 125 at approximately the side of the hand below the individual's fifth or smallest finger. Its connection is adjustable whereby the band encircling the wearer's hand below the base of the thumb formed by second end 125 and third band 140 may be varied in size to fit the wearer's hand by selectively inserting the bar 128 of the buckle 127 into the selected hole of the plurality of aligned loop holes 144. The plurality of aligned loop holes 144 provide means for varying the length of the band member in accordance with the circumference of the wearer's hand.

As should now be understood, the second and third bands 130, 140 completely encircle the thumb and lower portion of wearer's hand (just above the wrist) to prevent the watch casing from shifting on the hand while being worn.

The first band 120 extends from the casing 112 as previously described to the side of the hand below the individual's fifth or smallest finger and attaches with the aligned loop holes 144 of the distal end 133 of the second band 130.

While the best mode for carrying out the invention has been described, those familiar with the art to which this invention relates will recognize various alternative designs and embodiments for practicing the invention. For example, in the above description, the watch holding structure was described with a casing used in association with a watch mechanism however, other mechanisms such as a cell phone or other like device can be used as well.

Thus, the above-described preferred embodiment is intended to be illustrative of the invention which may be modified within the scope of the appended claims.

I claim:

1. A device holding structure for holding a device casing on the top of a wearer's hand comprising:

a first band having a first end attached to the device casing and a second end having a buckle, a second band having a first end attached to the device casing and further including a first band member and a second band member, said first band member having a first band length and a distal end that includes an attachment, wherein said second band member extends downward from said device casing and has a second band length for extending from said casing across the back of the hand and extending across the palm to a distal end, and including an element disposed approximately midway said second band length and further including said distal end having a plurality of loop holes, said element releasably receives said attachment of said first band member, wherein said buckle being attached to one of said plurality of loop holes such that said first band and second band member are adapted to encircle the wearer's hand below the base of the wearer's thumb, wherein said first band member extends upward from said device casing and is adapted to pass between the wearer's thumb and index finger such that the attachment extends around the thumb and attaches to the element and, wherein said first band further defines an angle such that the first band extends downward from said device casing.

2. The device holding structure as recited in claim 1, wherein when said buckle is attached to one of said plurality of loop holes, said loop holes are at approximately the side of the wearer's hand below the wearer's fifth or smallest finger.

3. The device holding structure as recited in claim 2, wherein said attachment for releasably attaching to said element approximately below the wearer's thumb on a palm-side of the wearer's hand.

4. The device holding structure as recited in claim 1, wherein said first and second bands are each attached to connecting elements of the device casing with connecting means.

5. The device holding structure as recited in claim 4, wherein said connecting means is a pin.

6. The device holding structure as recited in claim 1, wherein said first band has a first band length of about 3 inches.

7. The device holding structure as recited in claim 1, wherein said second band member generally has a "Y" configuration that defines a "V" configuration between said first and second band members.

8. The device holding structure as recited in claim 1, wherein said attachment includes a releasable button that communicates with said element such that pushing said button releases said attachment from said element.

9. A device holding structure for holding a device casing on the top of a wearer's hand comprising:

a first band having a first end in communication with the device casing and a second end, a second band having a first end in communication with the device casing and defining a first band member and a second band member, said second band member having an end, wherein said first band defines an angle such that the first band extends downward from the device casing, wherein said first band member extends upward from the device casing and adapted to pass between the wearer's thumb and index finger and attached to said second band member, wherein said second band member extends downward from the device casing, and wherein said first band and second band members are adopted to encircle the wearer's hand below the base of the wearer's thumb such that said second end of said first band is in communication with said end of said second band member.

* * * * *